US009423205B1

(12) United States Patent
Mitchell

(10) Patent No.: US 9,423,205 B1
(45) Date of Patent: Aug. 23, 2016

(54) ORB LAUNCHING DEVICE

(71) Applicant: Jeffrey R Mitchell, Tallahassee, FL (US)

(72) Inventor: Jeffrey R Mitchell, Tallahassee, FL (US)

( * ) Notice: Subject to any disclaimer, the term of this patent is extended or adjusted under 35 U.S.C. 154(b) by 0 days.

(21) Appl. No.: 14/622,723

(22) Filed: Feb. 13, 2015

(51) Int. Cl.
*F41B 7/00* (2006.01)
*F41B 7/08* (2006.01)

(52) U.S. Cl.
CPC .. *F41B 7/003* (2013.01); *F41B 7/08* (2013.01)

(58) Field of Classification Search
CPC ..... F41B 7/003; F41B 7/08
See application file for complete search history.

(56) References Cited

U.S. PATENT DOCUMENTS 8,991,374 B1 * 3/2015 Conkel ..... F41B 5/126 124/23.1

FOREIGN PATENT DOCUMENTS

DE 202012004887 U1 * 6/2012 ..... F41B 7/003

* cited by examiner

*Primary Examiner* — Gene Kim
*Assistant Examiner* — Jeffrey Vanderveen
(74) *Attorney, Agent, or Firm* — J. Wiley Horton

(57) ABSTRACT

A toy projectile launching device. The device preferably includes a handle, barrel, muzzle, trigger, cocking shaft, and cocking handle. The device uses a spring loaded shaft in order to launch an orb. In addition, the launching mechanism of the device imparts rotation upon the orb, which stabilizes the orb in flight—thereby achieving an increase in sustained velocity and an increase in the distance traveled.

20 Claims, 11 Drawing Sheets

ORB LAUNCHING DEVICE

BACKGROUND OF THE INVENTION

1. Field of the Invention

This invention relates to the field of toy projectile launching devices. More specifically, the present invention comprises a projectile launcher which launches a spin-stabilized orb.

2. Description of the Related Art

Toy projectile launchers are commonly used by children for target practice and for war-type games. Projectile launchers come in many forms, such as slingshots, bows, gun-type devices, and a multitude of other devices. Of course, each of those devices typically uses a different type of projectile. For example, a bow uses an arrow as a projectile and a slingshot launches a small round pellet, rock, or water balloon.

In addition, particular launchers are designed to launch different projectiles. As an example, the reader will realize that gun-type projectile launchers are often used to launch a variety of projectiles, including bullets, spherical pellets, cylindrical pellets, and many others. Oftentimes, the type of projectile to be launched decides the mechanism incorporated in the toy launcher. For example, a designer may not employ the same launching mechanism for a flat disk as he or she would for spherical projectile.

Toy projectile launchers currently exist in the art. An example of a projectile launcher is found in U.S. Pat. No. 4,059,089 to Lehman (1977). The Lehman device launches projectiles using a trigger and plunger setup. A similar approach is taken in U.S. Pat. No. 8,336,531 to Fan et al. (2012). In other cases, a device that sprays water may be used as a children's toy.

Oftentimes, the projectile to be launched is fabricated out of a rigid material-such as plastic or wood. A hard projectile material generally assists with the transfer of momentum from the launcher to the projectile, allowing a higher velocity. However, there are obvious safety concerns when dealing with a hard projectile. Thus, toy manufacturers have limitations on the velocity that may be imparted to a hard projectile.

On the other hand, a manufacturer may increase the velocity of a projectile if it is fabricated from a soft and flexible material. Unfortunately, it is typically more difficult to impart a high velocity upon a flexible projectile than it is on a rigid projectile. The deformation of the projectile as the launching mechanism contacts the projectile reduces the momentum transferred to the projectile, thereby reducing the velocity. It is also difficult to stabilize the flight path of a soft projectile. The deformation introduced by the momentum-transferring mechanism tends to remain as the projectile leaves the launcher. This deformation often causes the projectile to tumble in flight. Thus, what is needed is a projectile launcher that (1) limits the reduction of momentum when launching a flexible projectile and, (2) produces a stable flight path for the flexible projectile. The present invention solves this and other problems, as will be described more particularly in the following text.

BRIEF DESCRIPTION OF THE INVENTION

The present invention comprises a toy projectile launching device. The device preferably includes a handle, barrel, muzzle, trigger, cocking shaft, and cocking handle. The device uses a spring loaded shaft in order to launch an orb. In addition, the launching mechanism of the device imparts rotation upon the orb, which stabilizes the orb in flight—thereby achieving an increase in sustained velocity and an increase in the distance traveled. The novel method of launching the orb imparts rotation on a flexible orb, which can be difficult. In addition, this method of launching allows the orb to reach a high velocity despite the flexible nature of the orb material.

In a preferred embodiment, the orb launching device can be cocked and left in the cocked position until the user is ready to fire the device. This is preferably done using a trigger system. In other embodiments the orbs are launched by simply pulling the cocking handle back and releasing it in one continuous sequence.

REFERENCE NUMERALS IN THE DRAWINGS

Figure 1:
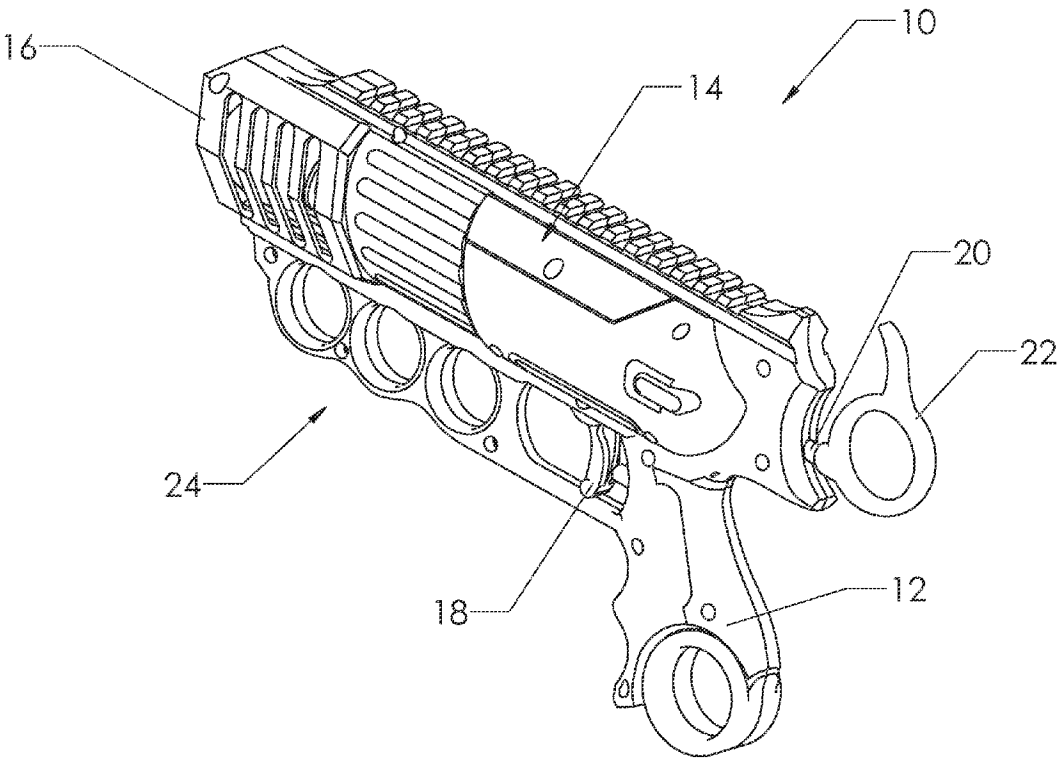
FIG. 1 is a perspective view, showing a preferred embodiment of the present invention.

10 orb launching device
12 launcher handle
14 chassis
16 muzzle
18 trigger
19 trigger pivot
20 cocking shaft
22 cocking handle
24 resistance grip
26 core
28 orb
30 central bore of core
32 orb retention rib
34 loading surface
36 helical cut
37 helical rib
38 central bore of orb
39 helical cut extreme
40 cocking shaft screw
42 retention surface
44 cocking spring
46 spring anchor
48 firing tab
50 trigger plunger
52 trigger catch
54 trigger plunger spring
56 catch plunger

58 catch spring
60 vertical wall
61 angled wall
62 main core body
64 orb holder
66 launching shaft
68 cocking knob

DETAILED DESCRIPTION OF THE INVENTION

The present invention provides a projectile launching device for use in target practice and other games played using a device which launches soft projectiles. FIG. 1 shows a preferred embodiment. Preferably, orb launching device 10 includes launcher handle 12, chassis 14, muzzle 16, trigger 18, cocking shaft 20, and cocking handle 22. Cocking shaft 20 is configured to slide in and out of chassis 14. In addition, orb launching device 10 includes resistance grip 24. Resistance grip 24 preferably allows the user to maintain a sufficient grip while pulling cocking handle 22 back in order to cock orb launching device 10. The reader will note that resistance grip 24 is shown as a multi-finger grip, but should not be limited to this. Resistance grip 24 could just as easily be a handle or other type of grip similar to launcher handle 12 or like that on a rifle.

Figure 2:
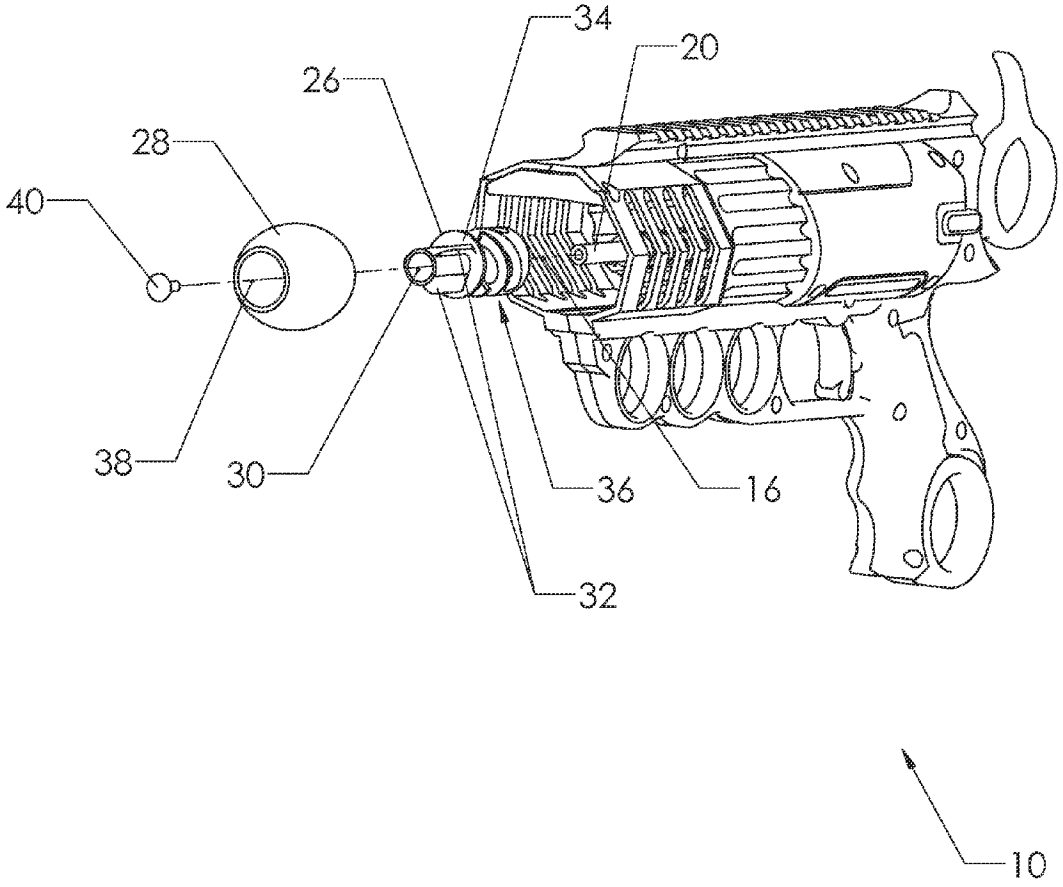
FIG. 2 is a perspective view, showing some of the components of the present invention.

FIG. 2 shows orb launching device 10 partially exploded in order to show details of the firing mechanism of orb launching device 10 proximate muzzle 16. The projectile in this particular embodiment is orb 28. Core 26 holds orb 28 prior to firing orb 28. Orb 28 is a solid object defined by a profile revolved about a longitudinal axis of symmetry (a "solid of revolution"). It is preferably made of a pliable material having enough mass so that its momentum will retain reasonable velocity in flight. The orb includes a central bore 38 that is centered on the longitudinal axis.

Figure 2B:
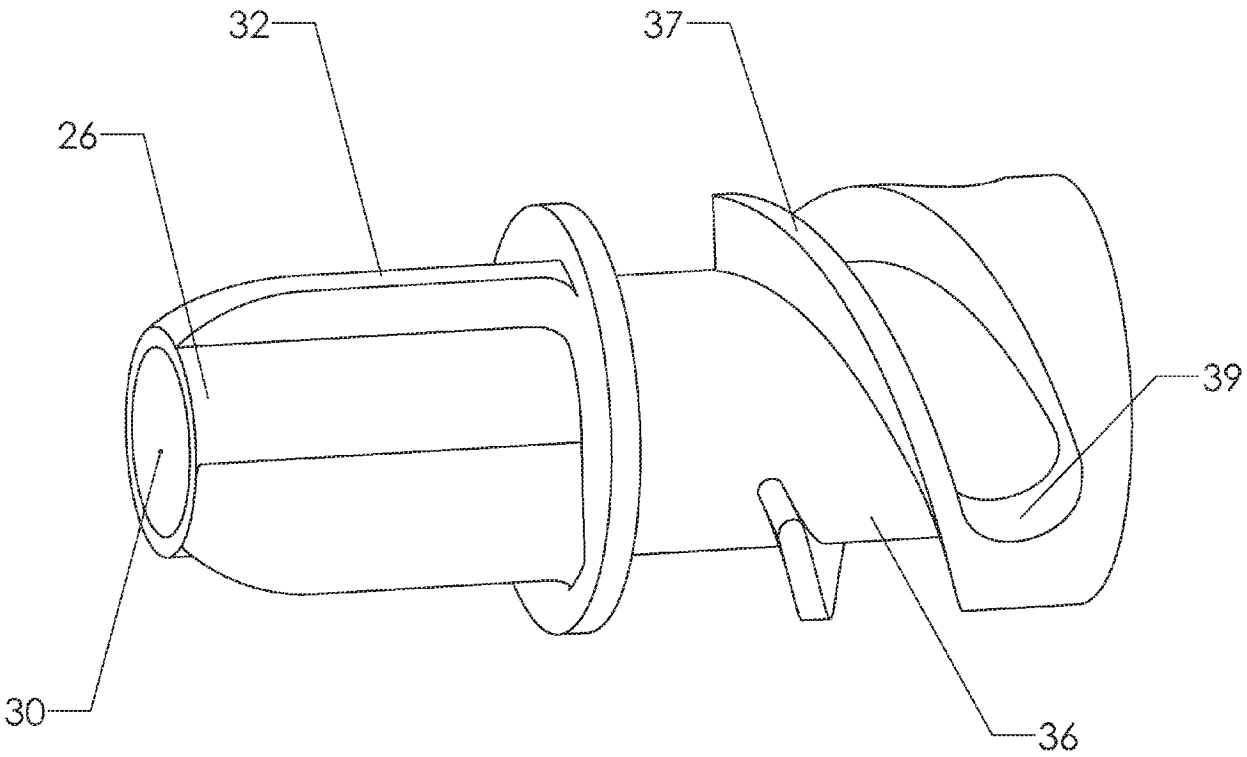
FIG. 2B is a perspective view, showing the core in more detail.

Preferably, core 26 includes central bore 30, orb retention ribs 32, loading surface 34, and helical cut 36. FIG. 2B shows core 26 in more detail. The reader will observe how helical cut 36 wraps around the perimeter of the core. Helical rib 37 segregates adjacent portions of helical cut 36. In this embodiment, multiple helical cuts and multiple helical grooves are included.

Returning now to FIG. 2, orb 28 is loaded onto core 26 by pressing the aft portion of orb 28 against loading surface 34 on core 26. In a preferred embodiment of the present invention, orb 28 is fabricated using foam or another flexible material. Thus, orb retention ribs 32 preferably have an effective diameter that is slightly greater than the diameter of the central bore 38 of orb 28. This allows the user to load orb 28 while carrying around orb launching device 10 without fear of orb 28 disengaging from core 26. The reader will note that orb retention ribs 32 include fillets on the loading end such that orb 28 easily fits onto core 26.

Another advantage to orb 28 being fabricated from a flexible material is that orb launching device 10 can fire orb 28 at a high speed with little fear of injuring someone/thing nearby. The present invention allows for a high-speed yet soft projectile.

Preferably, the central bore 30 of core 26 is axially aligned with cocking shaft 20. Preferably, the diameter of central bore 30 of core 26 is slightly larger than the outer diameter of cocking shaft 20 such that core 26 is capable of translating axially along cocking shaft 20. The diameters of central bore 30 of core 26 and cocking shaft 20 are such that core 26 can rotate as well as translate on that axis. The importance of this will become apparent in the following text.

Cocking shaft screw 40 is affixed to cocking shaft 20. Those familiar with the art will realize that shaft screw 40 can be attached to cocking shaft 20 using multiple techniques. Some examples of how the two can be affixed are that shaft screw 40 can be externally threaded while cocking shaft 20 is internally threaded, shaft screw 40 and cocking shaft 20 can be a snap-type attachment, or shaft screw 40 can be affixed to shaft 20 using epoxy or another adhesive (The use of the word "screw" to name this component should not be viewed as limiting the feature to threaded devices). Although it is not visible in FIG. 2, central bore 30 includes an additional surface which is large enough to catch cocking shaft screw 40, thereby preventing core 26 from disengaging from shaft 20 (although core 26 is free to rotate around shaft 20). In addition, as the user pulls cocking shaft 20 back, cocking shaft screw 40 engages this surface within central bore 30, thereby pulling core 26 back as well. This will be discussed further in the following text.

Figure 3:
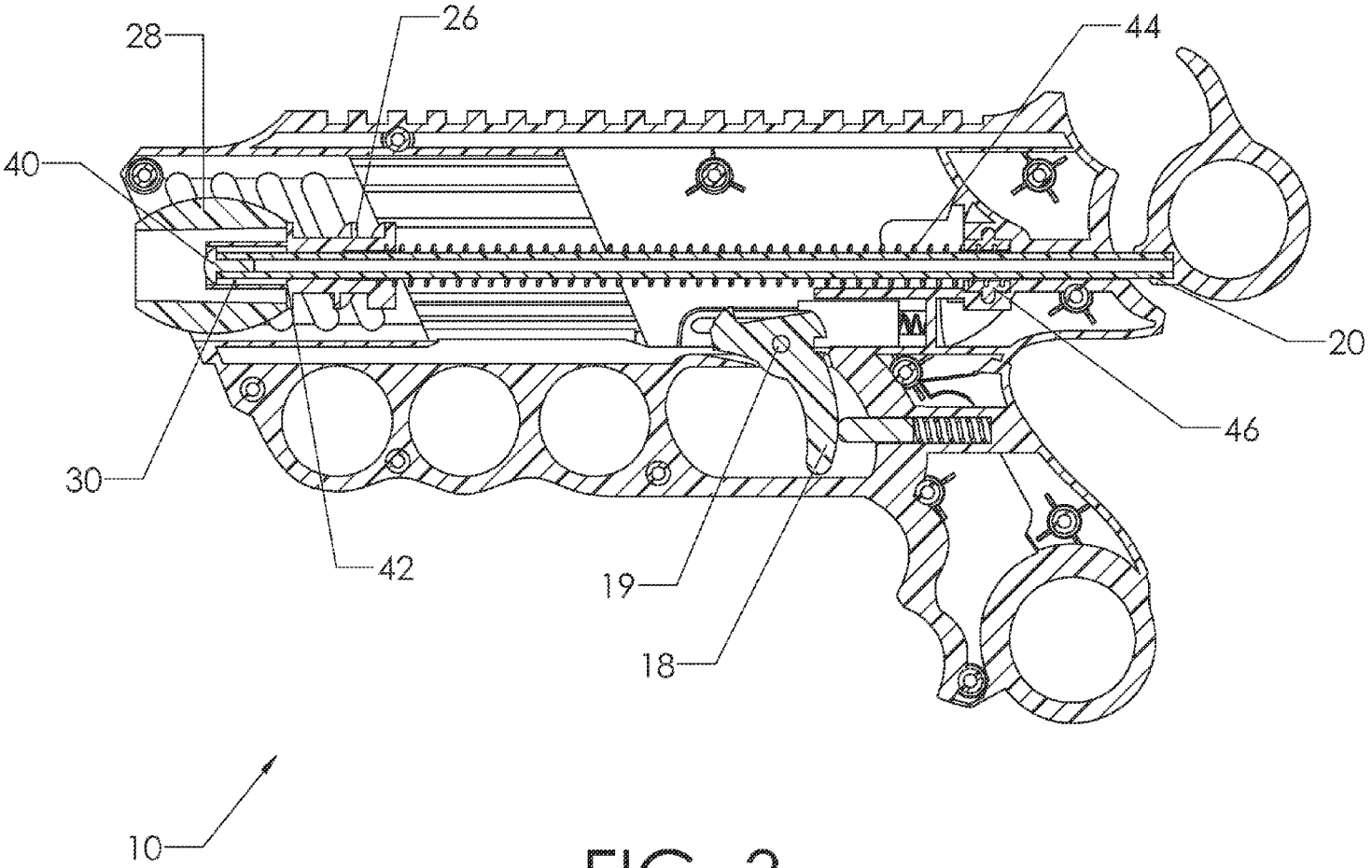
FIG. 3 is a sectional view, showing the present invention in an un-cocked state.

FIG. 3 shows a sectional view of orb launching device 10 in an "un-cocked" state. In this state, orb 28 is not capable of being fired (until a user cocks the device). The reader will note that this is the result of two factors—(1) cocking shaft 20 is not pulled back and (2) trigger 18 is in a depressed state. As discussed in the preceding text, cocking shaft screw 40 is attached to cocking shaft 20. The reader will note that cocking shaft screw 40 does not fit flush over shaft 20 but instead extends outward from the perimeter of cocking shaft 20.

As discussed previously, central bore 30 of core 26 includes retention surface 42 (an annular flange). The overlapping portion of screw 40 is separated from retention surface 42 in the configuration of FIG. 3. However, when a user grasps cocking shaft 20 and pulls it toward the cocking position (toward the right in the orientation of FIG. 3), the overlapping portion of screw 40 bears against retention surface 42 and pulls core 26 along with the cocking shaft.

Preferably, cocking spring 44 fits over cocking shaft 20 in such a way that it is capable of translation/compression, but with as little play as possible. In a preferred embodiment of the present invention, one end of cocking spring 44 is embedded within core 26, thereby allowing torsional stress to be applied to cocking spring 44 as core 26 is rotated. Of course, the other end of spring 44 must also be fixed in order to build a torsional force within cocking spring 44. This is achieved using spring anchor 46, which is fixedly attached to chassis 14 (either directly or indirectly). Spring anchor 46 includes helical grooves and a stop that prevent cocking spring 44 from rotating past a certain point within spring anchor 46, thereby building torsional tension as spring 44 is rotated. Although spring anchor 46 is illustrated as a separate part in this embodiment, spring anchor 46 may be integral to the chassis of the orb launcher 10. Still looking at FIG. 3, those skilled in the art will realize that as a user urges cocking shaft 20 to the right, core 26 and the attached orb 28 are also moved to the right. At the same time, cocking spring 44 is compressed linearly. This is discussed further in the subsequent text.

FIGS. 4-8 show the cocking sequence used in a preferred embodiment of the launcher. The mechanism employed both compresses and twists spring 44. This dual motion is significant. When the compressed and twisted spring is released (such as by pulling the launcher's trigger), core 26 is both accelerated linearly and rotationally. It thereby propels the orb forward and also spins the orb so that when the orb is propelled free of the launcher it is spin-stabilized in flight.

Figure 4:
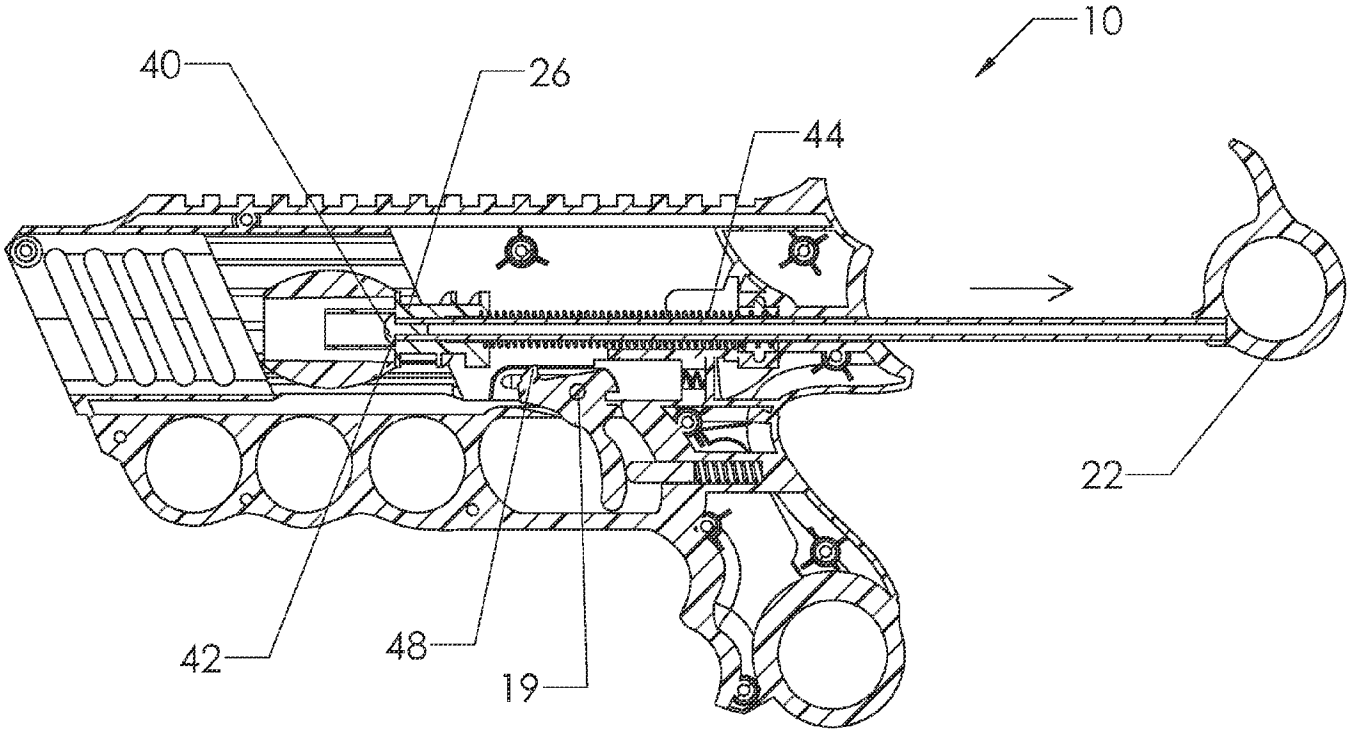
FIG. 4 is a sectional view, showing the present invention as it is being cocked.

The mechanisms that are used in this particular embodiment to both compress and twist spring 44 will now be described in detail. The reader should bear in mind that many other mechanisms could be employed to achieve these objectives. FIG. 4 shows orb launching device 10 as the user first pulls back on cocking handle 22. As illustrated, cocking shaft screw 40 is engaged with retention surface 42, which has caused core 26 to travel back as well. In addition, cocking spring 44 has begun to compress. The reader will note that up to this point there is no significant torsional stress on cocking spring 44 (pure compression does introduce a small amount of torsional stress in a coil spring).

Figure 5:
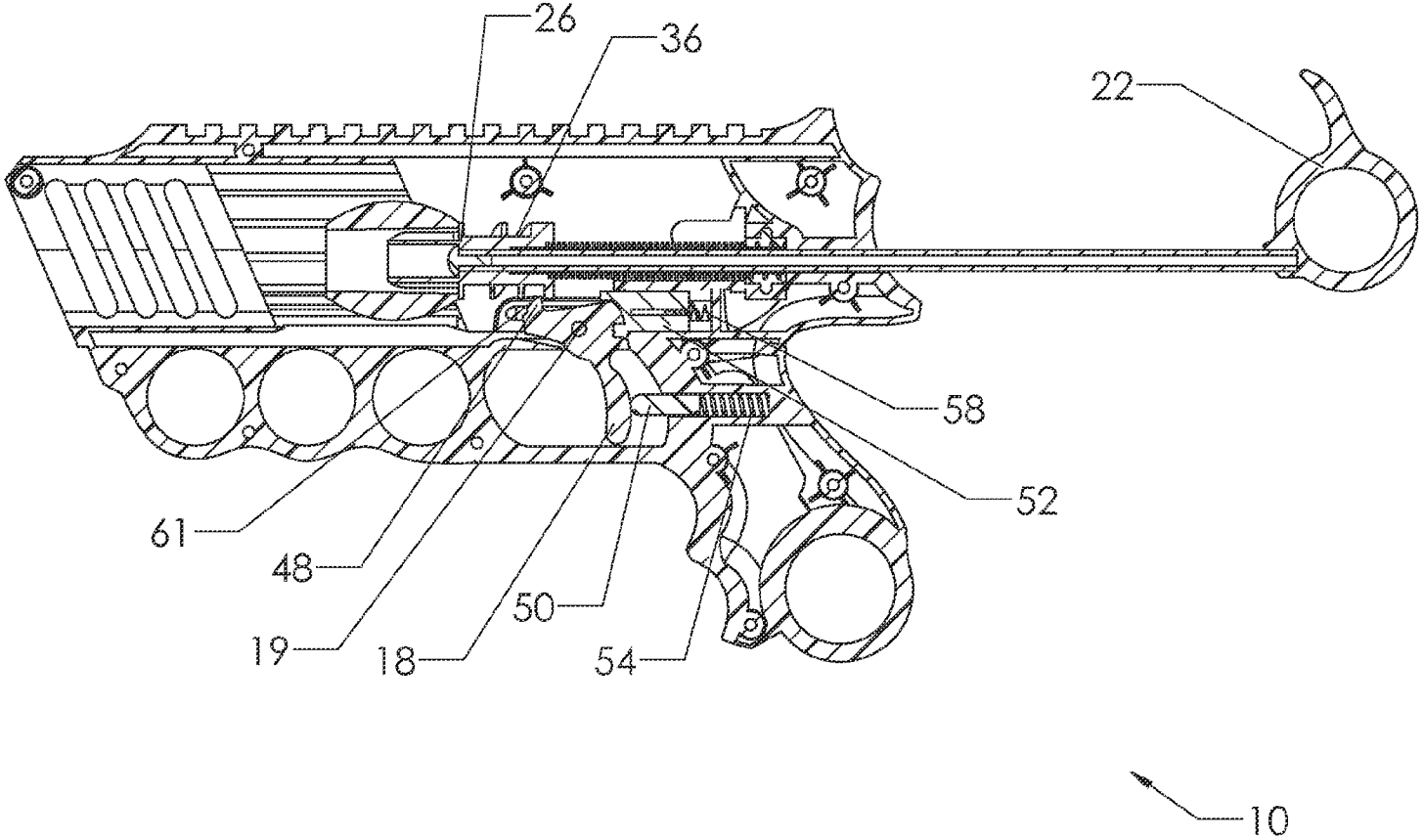
FIG. 5 is a sectional view, showing the present invention as a user begins to cock the orb launching device.
Figure 6:
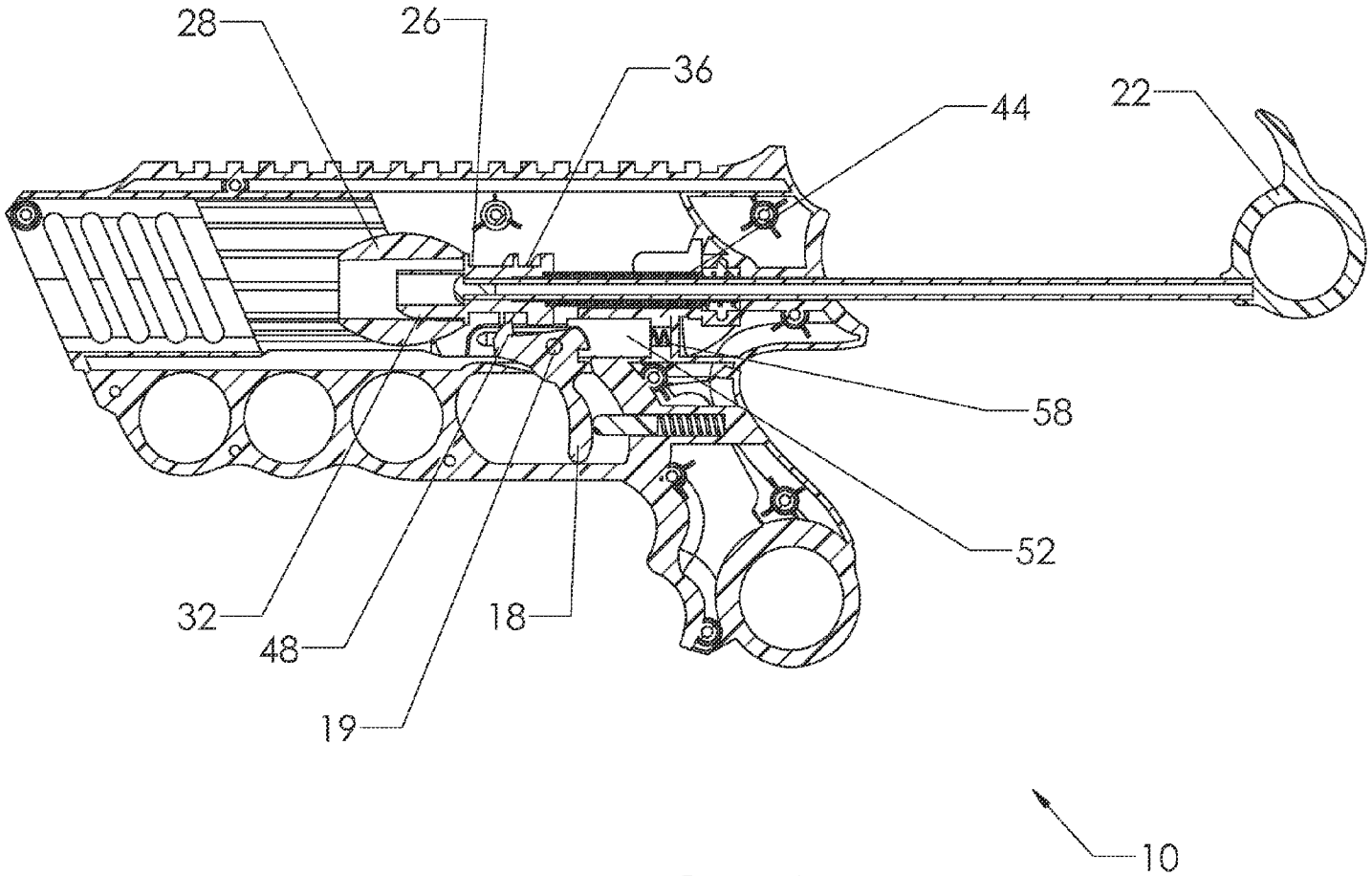
FIG. 6 is a sectional view, showing the present invention as a user continues to cock the orb launching device.

In FIG. 5, the user has continued to pull rearward on cocking handle 22. The reader will note that trigger 18 pivots about trigger pivot 19. Preferably, core 26 does not interact with firing tab 48 while the device is being cocked. In the event that firing tab 48 does interact with the core, it does so in the following manner. The firing tab has an angled forward-facing surface and a vertical rearward facing surface. In the position shown in FIG. 5, the aft extreme of core 26 (a flat, annular surface) has ridden over angled wall 61 (the forward-facing wall) of firing tab 48. In FIG. 6, helical rib 37 has just come to rest against the angled forward-facing wall 61 of firing tab 48 in this instantaneous snapshot.

Trigger 18 and firing tab 48 are preferably held in place while orb launching device 10 is being moved to the completely cocked position. This is achieved using trigger plunger 50 and trigger catch 52. Trigger plunger 50 is loaded using trigger plunger spring 54. Trigger plunger spring 54 preferably maintains a constant force on trigger plunger 50, which urges trigger 18 forward and urges firing tab 48 upward. However, trigger catch 52 prevents trigger 18 from rotating about trigger pivot 19 (The reader will note that a protrusion on the forward facing portion of trigger catch 52 engages a notch on a rear surface of trigger 18). Trigger catch 52 is urged forward and into engagement with the trigger by catch spring 58. The trigger catch assembly keeps trigger 18 in the position shown until trigger catch 52 is forced backwards by core 26 (as the launcher is fully cocked).

Preferably, as the user continues to pull rearward on cocking handle 22 in FIG. 6, helical rib 37 does not interact with the forward-facing angled wall 61 of firing tab 48. However, in some embodiments, or in the event that trigger 18 or firing tab 48 are misaligned, helical rib 37 slides along the forward-facing angled wall 61 of firing tab 48 without hindering the axial motion of core 26.

Figure 7:
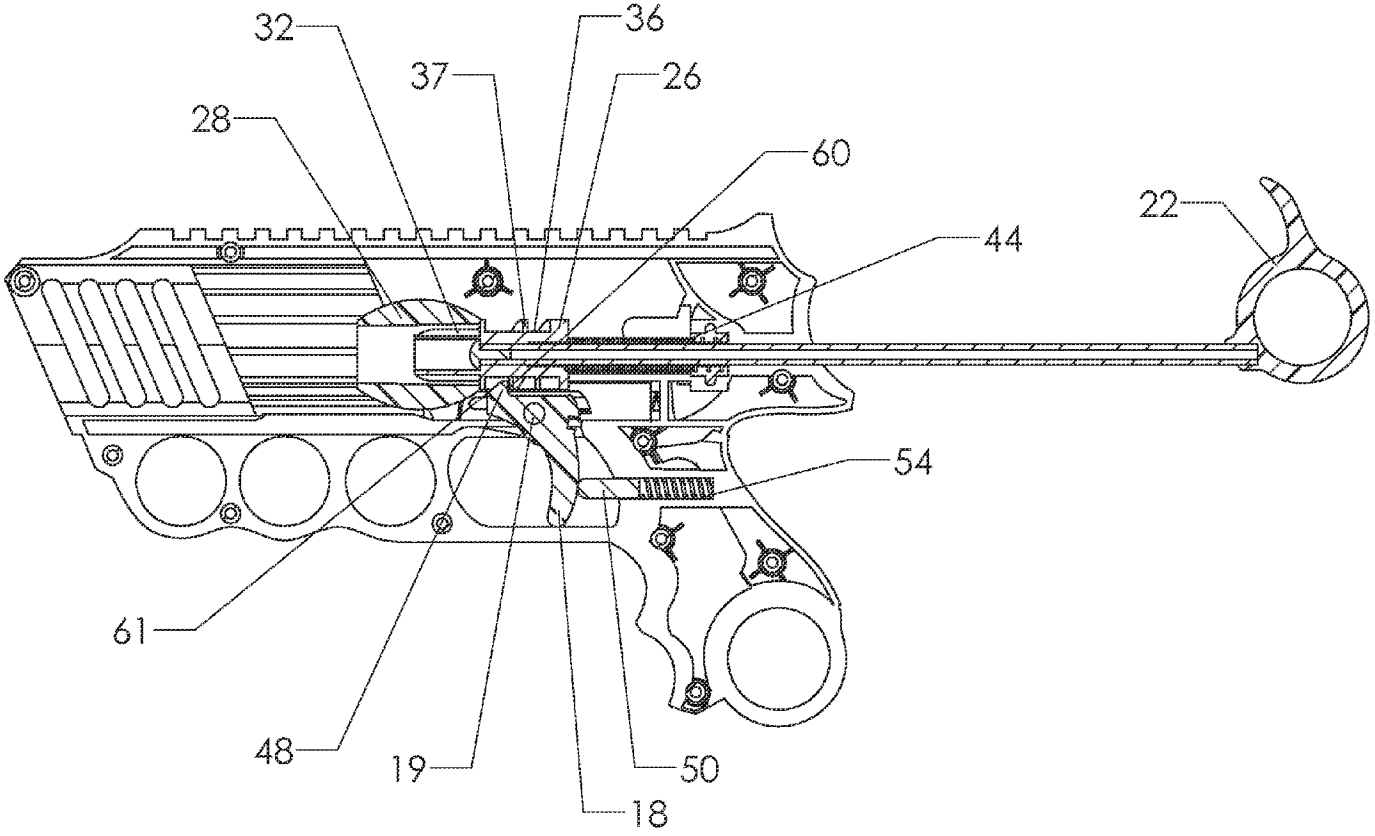
FIG. 7 is a sectional view, showing the instant when the firing tab enters the helical groove in the core.

Finally cocking handle 22 is pulled rearward until the aft end of core 26 contacts the forward end of trigger catch 52 and pushes it rearward. This is shown in FIG. 7. As this occurs trigger catch 52 moves out of engagement with trigger 18 and trigger 18 pivots clockwise (in the orientation of FIG. 7) so that firing tab 48 moved upward and into full engagement with the helical ribs and helical groove of core 26. Vertical wall 60 (rearward-facing) of firing tab 48 bears against the helical rib on the core.

Figure 8:
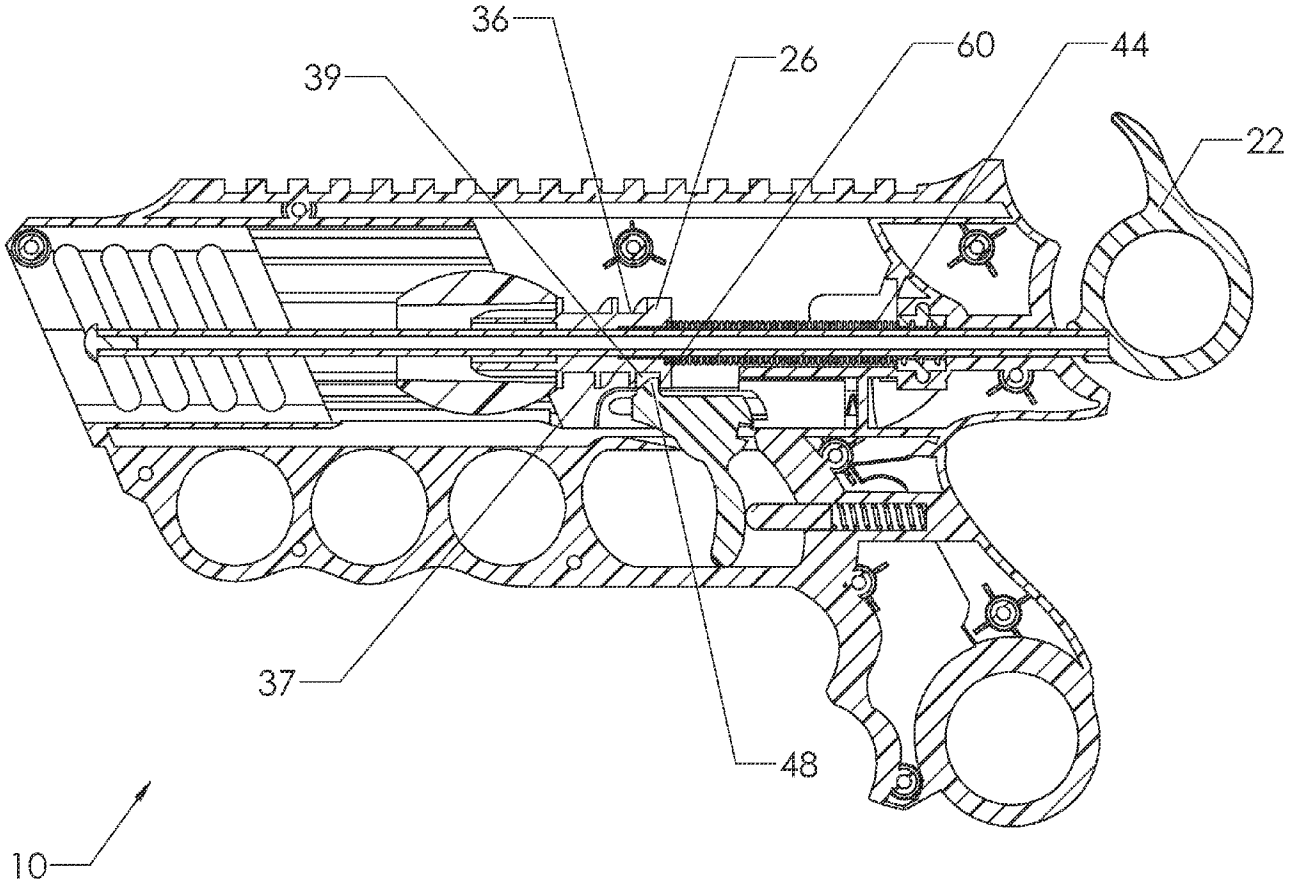
FIG. 8 is a sectional view, showing the orb launching device in a fully cocked state.

At this point, the user releases cocking handle 22. FIG. 8 illustrates the configuration of orb launching device 10 the moment after the user has released cocking handle 22. The reader will note that in FIG. 7, vertical wall 60 is resting against helical rib 37 in a manner that is unstable. Cocking spring 44 is urging core 26 to the left (in FIG. 7). Thus, once cocking handle 22 is released vertical wall 60 on firing tab 48 translates along helical rib 37 within helical cut 36. This translation occurs until firing tab 48 reaches helical cut extreme 39 (shown in FIG. 2B). As firing tab 48 translates within helical cut 36, core 26 rotates axially over cocking shaft 20. Because both ends of cocking spring 44 are prevented from rotating, this rotation creates a torsional stress on cocking spring 44 in addition to the compressive stress.

The reader will also note that cocking shaft 20, cocking handle 22, cocking shaft screw 40 have returned to the unloaded state in FIG. 8. Once the user releases cocking handle 22, cocking shaft 20 returns to the state shown in FIG. 3. Those familiar with the art will note that this can be done using many different techniques. In a preferred embodiment, cocking shaft 20 is spring loaded or elastically pulled back to the position shown in FIG. 3 after every cocking of orb launcher 10.

The launcher is at this point cocked and ready to fire. The reader will recall that cocking spring 44 has been both compressed and twisted at this point. It is held on both ends so that it cannot untwist. One end is secured in a rotation-limiting way to the chassis, while the opposite end is secured in a rotation-limiting way to core 26. In addition, core 26 is unable to twist or move forward because it is held in place by firing tab 48.

In order to fire the launcher, the user pulls trigger 18. Trigger 18 then pivots in an anti-clockwise direction (in the orientation of FIG. 8)—thereby pulling firing tab 48 free of the helical groove in the core. Cocking spring 44 then thrusts core 26 and orb 28 forward. At the same time—because of the torsion imparted to spring 44—core 26 and orb 28 are also accelerated rotationally.

Those familiar with the art will realize that when a user is playing a war-type game whereby players fire orbs 28 at each other, the pre-cocked state gives the user an advantage, allowing him or her to fire orb launching device immediately.

The rotation of core 26 imparts rotation upon orb 28. Rotation of orb 28 increases the likelihood that orb 28 will remain traveling along the major axis of orb 28, which is the orientation with the least amount of drag. As orb 28 travels, the velocity and distance are maximized as it travels along the major axis. By rotating core 26 while cocking orb launching device 10, the trigger assembly is simplified. Firing tab 48 is only required to release core 26 because the required rotation is already imparted upon core 26. Once the user pulls trigger 18, orb launching device 10 returns to the state shown in FIG. 3.

Figure 9:
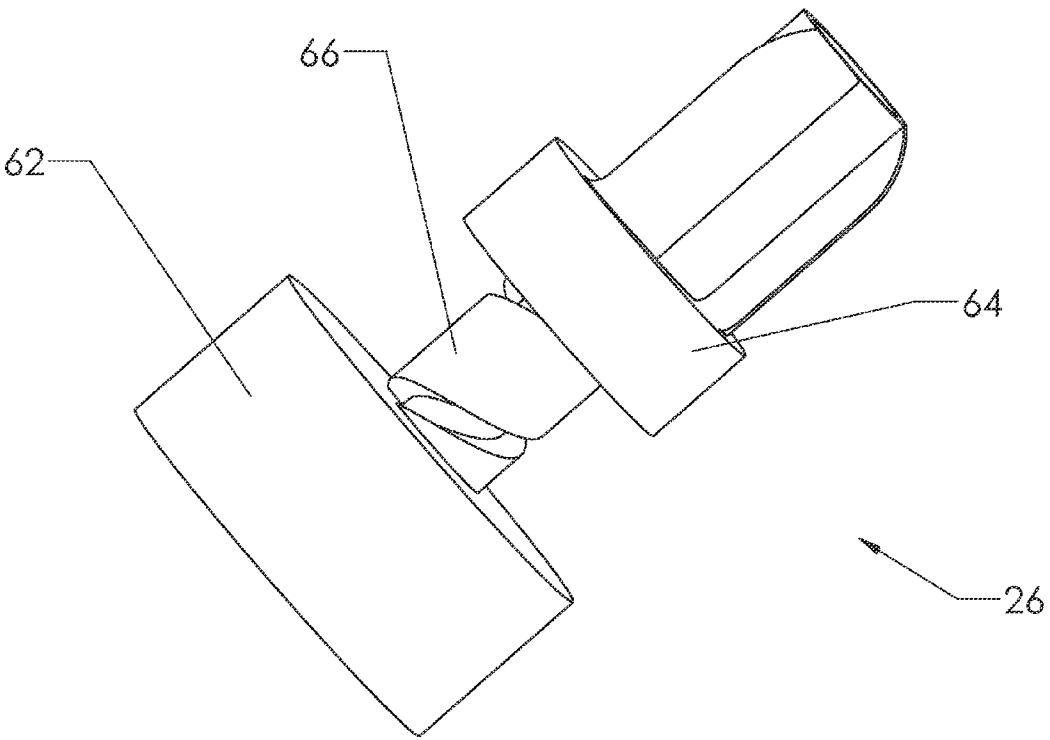
FIG. 9 is perspective view, showing an alternate embodiment of the core.

FIG. 9 shows an alternate embodiment of core 26. This particular embodiment imparts rotation upon orb 28 without out the need to "wind up" core 26. In other words, this particular embodiment of core 26 does not require a torsional stress to be imparted upon cocking spring 44. Preferably, main core body 62 is connected to spring 44 and cocking shaft 20. Orb holder 64 begins pressed against main core body 62, such that threaded shaft 66 is not visible. Once main core body 62 reaches the end of cocking shaft 20, main core body 62 stops. However, the momentum coupled with thread shaft 66 cause orb holder 64 to rotate and continue to travel axially, thereby imparting rotation upon orb 28.

In addition to the orb launching device 10 shown in FIGS. 1-8, the core 26 shown in FIG. 9 can be used with a pneumatic embodiment of orb launcher 10. This version would allow the user to use similar cocking and firing method as the preferred embodiment, but using a chamber of air. This burst of air would force main core body 62 to muzzle 16. Then, when core 26 stops orb holder 64 will rotate and release orb 28.

Figure 10:
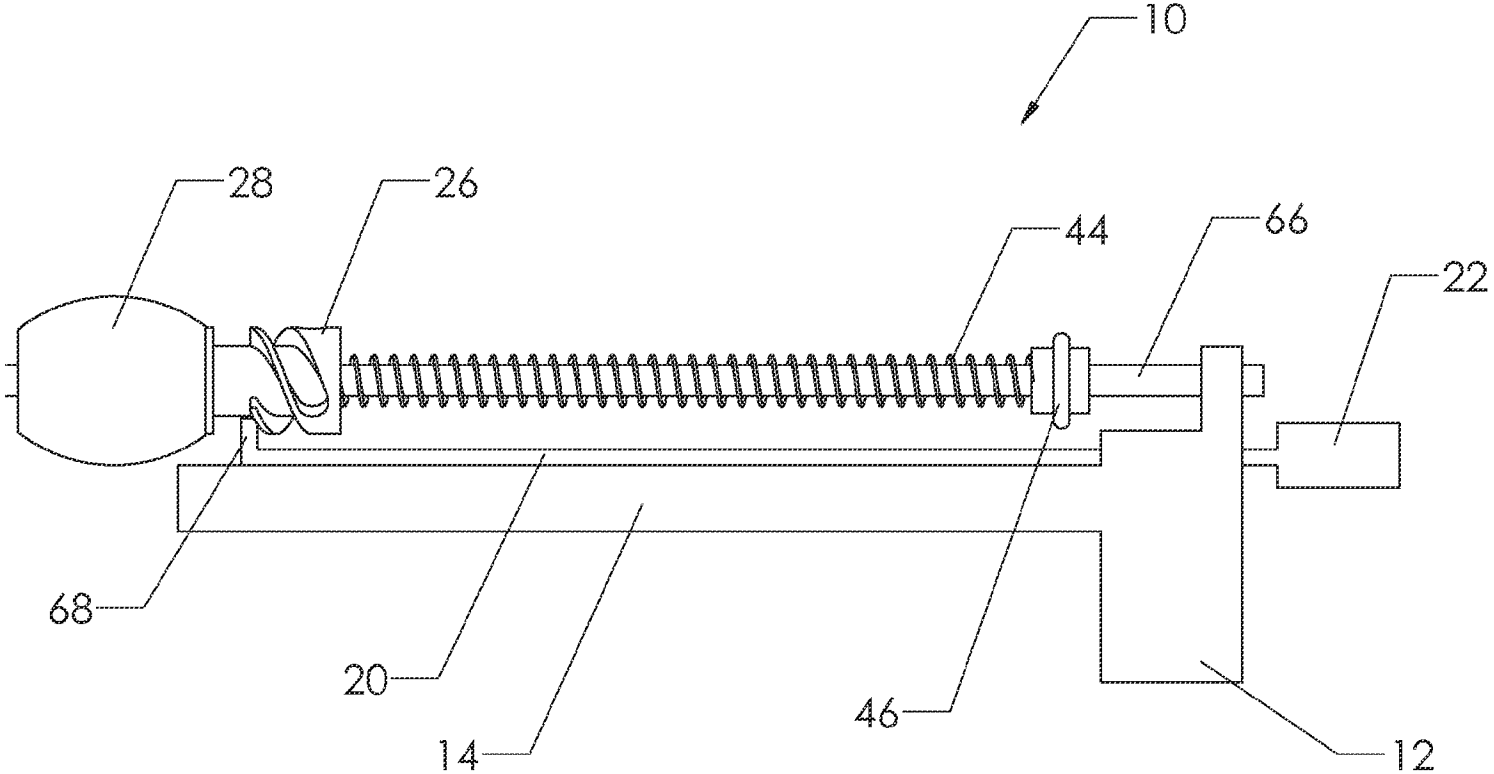
FIG. 10 is an elevation view, showing an alternate embodiment of the present invention.

FIG. 10 shows an alternate embodiment of orb launching device 10. The reader will note that this is a simplified version of the present invention. Preferably, orb launching device 10 includes handle 12, barrel 14, cocking shaft 20, cocking handle 22, launching shaft 66, cocking spring 44, core 26, and spring anchor 46. Preferably, cocking shaft 20 translates within a channel located within barrel 14 which allows cocking shaft 20 to travel linearly along the firing axis.

The firing mechanism for this particular embodiment is very similar to that seen in FIGS. 1-8. The user pulls back on cocking handle 22, which traverses cocking shaft 20 backwards through the channel in barrel 14. As this occurs cocking knob 68 rotates core 26 as knob 68 pulls core 26 back. As before, cocking spring 44 is embedded into core 26, thereby preventing rotation of cocking spring 44 in conjunction with spring anchor 46. The reader will note that this embodiment of orb launcher 10 does not include a trigger system. Thus, a different launching mechanism must be employed. In order to launch orb 28, the channel in barrel 14 ramps downward towards the handle 12 of orb launching device 10. Once cocking handle 22 reaches the ramp in the channel, cocking knob 68 is forced downward. This disengages cocking knob 68 from core 26, thereby launching orb 28. Of course, there are advantages and disadvantages to each embodiment-simplicity on one side and convenience/ease of use on the other. The embodiment of FIG. 10 may also include some additional housing components and covers to avoid the users' from placing hands and/or fingers into the firing mechanism. In addition, cocking shaft 20 would be well suited to fit into a channel that connects to handle 12.

The preceding description contains significant detail regarding novel aspects of the present invention. It should not be construed, however, as limiting the scope of the invention but rather as providing illustrations of the preferred embodiments of the invention. Thus, the scope of the invention should be fixed to the following claims, rather than specific examples given.

Having described my invention, I claim:

1. A method for launching a projectile, comprising:

a. providing a chassis, including
   i. a cocking shaft, and
   ii. a cocking spring having a first end and a second end, said cocking spring being mounted on said cocking shaft;

b. providing a core, slidably mounted on said cocking shaft, said core including a loading surface and an outward-facing helix;

c. wherein said first end of said cocking spring is attached to said core using a rotation-limiting connection and said second end of said cocking spring is attached to said chassis using a rotation-limiting connection;

d. providing a projectile formed as a solid of revolution around a central axis, said projectile having a central bore along said central axis and an aft extreme;

e. placing said central bore of said projectile over said core and said aft extreme of said projectile against said loading surface of said core;

f. compressing said cocking spring by urging said projectile and said core rearward with respect to said chassis;

g. providing a tab connected to said chassis;

h. torquing said cocking spring by engaging said tab in said helix so that a mechanical interface between said tab and said helix rotates said core as said core travels rearward with respect to said chassis; and i. releasing said cocking spring, said cocking spring being configured to simultaneously accelerate said core linearly and rotationally and propel said projectile away from said chassis with a linear and rotational motion.

2. A method for launching a projectile as recited in claim 1 further comprising:

a. wherein said attachment between said core and said cocking spring is both rotation-limiting and translation-limiting; and b. wherein said attachment between said chassis and said cocking spring is both rotation-limiting and translation-limiting.

3. A method for launching a projectile as recited in claim 1 wherein said core includes a plurality of retention ribs configured to engage said central bore of said projectile.

4. A method for launching a projectile as recited in claim 3, wherein:

a. said projectile is made of a pliable material, and b. said retention ribs are configured to deform said pliable material as they engage said central bore.

5. A method for launching a projectile as recited in claim 1, wherein:

a. said chassis includes a moveable trigger, and b. said trigger is configured to release said cocking spring.

6. A method for launching a projectile as recited in claim 1, wherein:

a. said chassis includes a cocking handle; and b. said cocking handle is configured to simultaneously compress and torque said cocking spring.

7. A method for launching a projectile as recited in claim 6, wherein:

a. said chassis includes a cocking handle; and b. said cocking handle is configured to simultaneously compress and torque said cocking spring.

8. A method for launching a projectile as recited in claim 2, wherein:

a. said chassis includes a moveable trigger; and b. said trigger is configured to release said cocking spring.

9. A method for launching a projectile as recited in claim 2, wherein:

a. said chassis includes a cocking handle; and b. said cocking handle is configured to simultaneously compress and torque said cocking spring.

10. A method for launching a projectile as recited in claim 3, wherein:

a. said chassis includes a moveable trigger; and b. said trigger is configured to release said cocking spring.

11. A method for launching a projectile, comprising:

a. providing a chassis, including
   i. a cocking shaft, and
   ii. a cocking spring having a first end and a second end, said cocking spring sliding along said cocking shaft;

b. providing a core, slidably mounted on said cocking shaft, said core including an outward-facing helix;

c. wherein said first end of said cocking spring is attached to said core using a rotation-limiting connection and said second end of said cocking spring is attached to said chassis using a rotation-limiting connection;

d. providing a projectile formed as a solid of revolution around a central axis, said projectile having a central bore along said central axis;

e. placing said central bore of said projectile over said core;

f. wherein said core is configured to propel and rotate said projectile;

g. compressing said cocking spring by urging said projectile and said core rearward with respect to said chassis;

h. providing a tab connected to said chassis;

i. torquing said cocking spring by engaging said tab in said helix so that a mechanical interface between said tab and said helix rotates said core as said core travels rearward with respect to said chassis; and j. releasing said cocking spring, said cocking spring being configured to simultaneously accelerate said core linearly and rotationally and propel said projectile away from said chassis with a linear and rotational motion.

12. A method for launching a projectile as recited in claim 11 further comprising:

a. wherein said attachment between said core and said cocking spring is both rotation-limiting and translation-limiting; and b. wherein said attachment between said chassis and said cocking spring is both rotation-limiting and translation-limiting.

13. A method for launching a projectile as recited in claim 11 wherein said core includes a plurality of retention ribs configured to engage said central bore of said projectile.

14. A method for launching a projectile as recited in claim 13, wherein:

a. said projectile is made of a pliable material; and b. said retention ribs are configured to deform said pliable material as they engage said central bore.

15. A method for launching a projectile as recited in claim 11, wherein:

a. said chassis includes a moveable trigger; and b. said trigger is configured to release said cocking spring.

16. A method for launching a projectile as recited in claim 11, wherein:

a. said chassis includes a cocking handle; and b. said cocking handle is configured to simultaneously compress and torque said cocking spring.

17. A method for launching a projectile as recited in claim 16, wherein:

a. said chassis includes a cocking handle; and b. said cocking handle is configured to simultaneously compress and torque said cocking spring.

18. A method for launching a projectile as recited in claim 12, wherein:

a. said chassis includes a moveable trigger; and b. said trigger is configured to release said cocking spring.

19. A method for launching a projectile as recited in claim 12, wherein:

a. said chassis includes a cocking handle; and b. said cocking handle is configured to simultaneously compress and torque said cocking spring.

20. A method for launching a projectile as recited in claim 13, wherein:

a. said chassis includes a moveable trigger; and b. said trigger is configured to release said cocking spring.

* * * * *